United States Patent [19]

Uhlmann et al.

[11] 3,934,449

[45] Jan. 27, 1976

[54] DRAWING ELONGATED STOCK, SUCH AS COPPER TUBING

[75] Inventors: Otto Uhlmann, Burgdorf; Norbert Stephan, Ahlem, both of Germany

[73] Assignee: Kabel-und Metallwerke Gutehoffnungshutte Aktiengesellschaft, Hannover, Germany

[22] Filed: Mar. 10, 1975

[21] Appl. No.: 557,107

[30] Foreign Application Priority Data

Mar. 23, 1974 Germany ..... 2414134

[52] U.S. Cl. ..... 72/289

[51] Int. Cl.[2] ..... B21C 1/02

[58] Field of Search ..... 72/142, 280, 289, 291; 242/81, 82

[56] References Cited

UNITED STATES PATENTS

| | | | |
|---|---|---|---|
| 3,147,934 | 9/1964 | Godderidge | 242/82 |
| 3,470,723 | 10/1969 | Remner | 72/289 |
| 3,747,869 | 7/1973 | Meyer | 242/82 |
| 3,827,274 | 8/1974 | Schuetz | 72/289 |

*Primary Examiner*—Lowell A. Larson
*Attorney, Agent, or Firm*—Ralf H. Siegemund

[57] ABSTRACT

Copper tubing is drawn through a die by means of a rotating drum to which the front end of the tube is fastened and may remain fastened as the drawn tubing is coiled on the drum, or the front is released, so that frictional engagement of multiple coils on the drum provide for pulling. An annulus pushes the coils down, but is retracted or remains ineffective as long as the front end of the tube is fastened.

3 Claims, 2 Drawing Figures

DRAWING ELONGATED STOCK, SUCH AS COPPER TUBING

BACKGROUND OF THE INVENTION

The present invention relates to drawing of elongated stock, such as copper tubing and using a drawing die, a rotating drum with clamp for drawing the tubing through the die.

Equipment of this type is constructed, for example, as to the following detail. In the so-called bull blocks, the tubing (or other elongated stock) is held by clamps throughout the drawing and is released only upon completion. The length of the drawn stock is limited here by circumferential and axial dimensions of the drawing drum.

The so-called spinner block differs from a bull block in that the stock is severed from the holding clamp after a few loops have been wound on the drum and frictional engagement of the drum by the loops provides for further pulling. The drum is vertically arranged and a disk pushes the loops down so that they drop into a container. Of course, a plurality of loops is always on the drum to provide for the necessary drawing force. It can thus be seen that this spinner block permits basically the processing of endless tubing.

Therefore, the bull block arrangement will be used for drawing e.g. tubes which are relatively light and short, so that all of it can be wound on the drum without having to provide for an excessively large (and heavy!) drum. One could wind tubing in two layers, but that is not too desirable, as the loops may become intertwined.

The spinner block has the added advantage of higher speed, but one has to start quite slowly, until, say, seven to nine loops have been wound, and they must be held against the periphery of the drum by rolls and to ensure transition of pulling by the clamp to pulling by frictional engagement when the end has been severed from the clamp.

DESCRIPTION OF THE INVENTION

It is an object of the present invention to provide for equipment for drawing elongated stock which permits operation as bull block as well as spinner block.

In accordance with the preferred embodiment of the present invention, it is suggested to provide a drawing drum with an annulus or disk which is movably disposed thereon for changing the effective axial length of the drum, so that it can work as bull block, possibly followed by operation as spinner block. Basically then, the construction is a spinner block, but with retractible annulus. The retraction and advance of the annulus is carried out preferably hydraulically, but could be obtained by electromotors.

It can thus be seen that the drum may be used in bull block configuration, i.e. with retracted coil shifting annulus to use most or all of the drum's periphery for winding drawn stock when a certain length of such stock is drawn in the first stage or stages of drawing. As the same stock is drawn again, through a smaller die or dies, operation in the spinner block mode may become necessary whereupon the annulus is protracted to push the coils down in steps after, of course, the front end has been released.

DESCRIPTION OF THE DRAWING

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
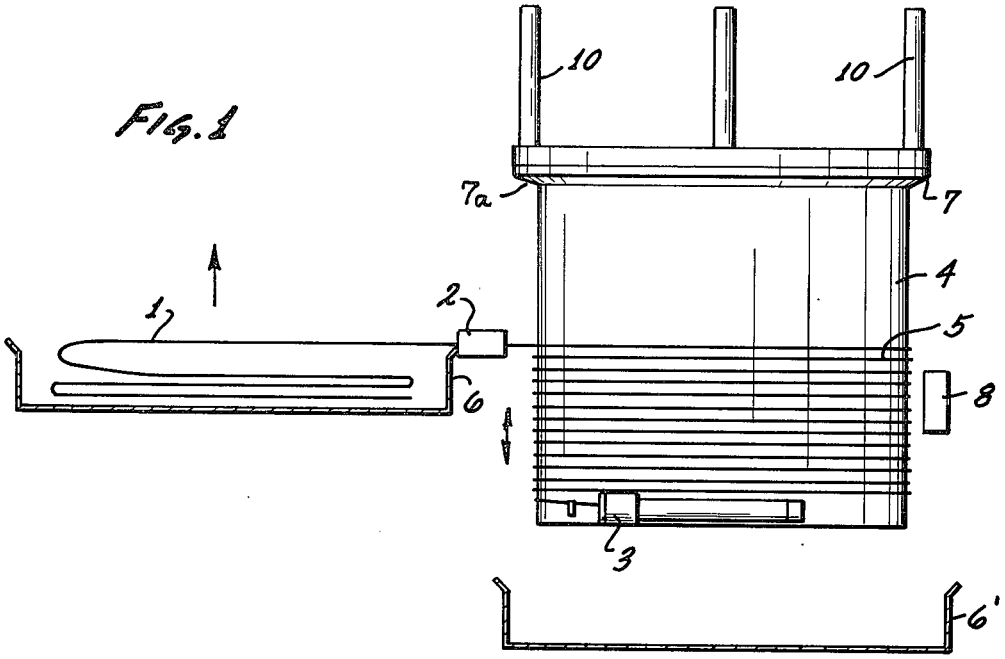
FIG. 1 is a schematic side elevation of equipment in accordance with the preferred embodiment of the invention, operating as bull block.

Proceeding now to the detailed description of the drawings elongated stock, such as copper tubing 1, is dispensed from an open container 6, a barrel, basket, or the like, wherein the tubing is stored in coiled configuration. Storing the tubing in this fahsion is an example only. Actually the tubing may be drawn or, better, withdrawn from a machine in which the tubing was first made (e.g. by continuous casting and/or press working) with subsequent pilgrim rolling to stretchroll the tubing for obtaining both, a reduction in wall thickness and elongation.

Presently, the tubing is to be drawn and for this, a drawing die 2 of conventional design is provided. The tubing is pulled and drawn through the die. Accordingly, a drawing drum 4 is provided, rotating on a vertical axis while being driven by a conventional drive (not shown).

The die 2 is suitably mounted on a thrust block and may be movable axially along the drum 4, or the drum may be movable axially relative to the die. In either case, relative axial movement between drum and die provides for placing of the drawn stock in spaced apart loops or coils onto the drum's periphery.

The drum has on its periphery a clamping mechanism 3, by means of which the front end of the tubing can be clamped and held, permitting pulling of the tubing upon rotation of the drum. Initially, the end of the tubing is sharpened and cut more or less to a point to permit easy threading through the die 2 for fasting that end to the clamp 3.

After the drum begins to rotate, the tube is drawn through the die 2 and the drawn tubing is coiled in spaced apart loops on the periphery of drum 4. Drawing and coiling can begin immediately with the highest speed of the system, if the device operates as bull block; all of the drawn tubing will be coiled onto drum 4, while the front end is continuously held by clamp 3. The coiling may be carried out with an opposite sense of winding as compared with the initial coil configuration in container 6. However, the drawing die will usually eliminate all elastic memory, so that the tubing is coiled on drum 4 from a straight configuration and is, therefore, under tension, tending to loosen the coils. Thus, as soon as the end of the stock 1 has passed through die 2, the tension relaxes and the coils are loosened. Upon opening the clamp 3 or severing the tubing 1 therefrom the coils drop into a basket 6'.

Figure 2:
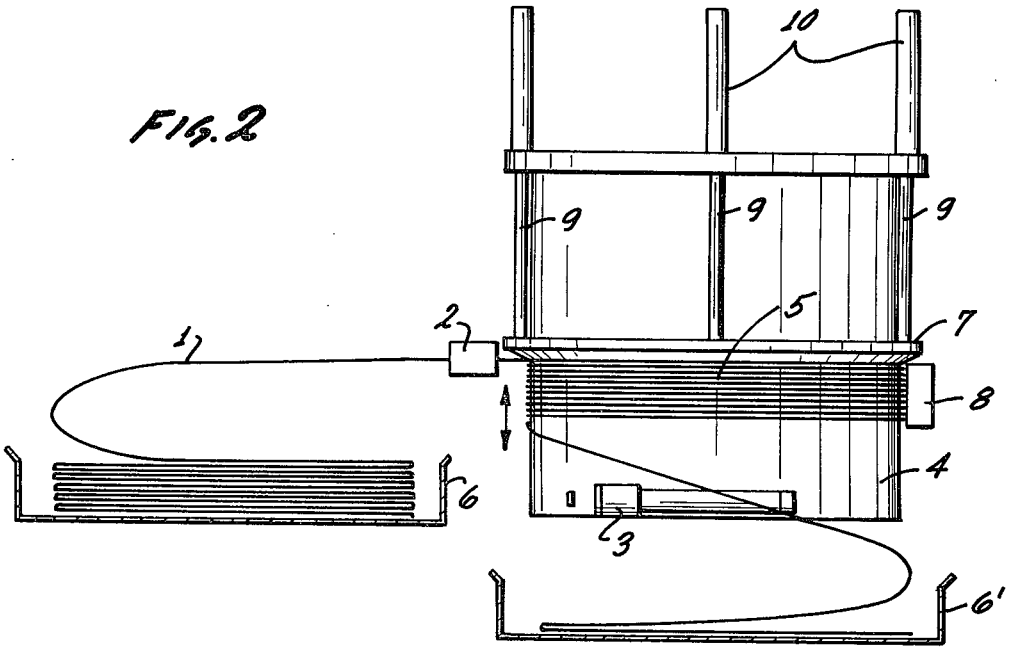
FIG. 2 shows the same equipment but now operating as spinner block.

The operation above has been described with reference to bull block type operation which presumes that the stock to be drawn is of such length that it does, in fact, still fit onto the drum 4 after having been drawn. If, for example, the same tubing is drawn repeatedly through dies of respectively smaller opening, the resulting tubing will become longer and longer. In that case, it may become necessary to operate the equipment in the second or spinner block mode as shown in FIG. 2.

The equipment has additionally an annulus or ring 7, which is traversed by drum 4, but held by piston rods 9, which in FIG. 1 are not visible, because they are retracted in cylinders 10. In other words, upon operating the device in the bull block mode, more or less maximum storage capacity of the drum 4 is made available by partial or complete retraction of annulus 7, as shown in FIG. 1. It was assumed there that the end of the material to be drawn was reached not later than when the die 2 reached a position close to the retracted annulus 7.

The annulus 7 with actuating mechanism 9, 10 is mounted on drum 4 and rotates therewith, whereby particularly annulus or ring 7 is carried along by means of a follower pin arrangement or the like. Essential is that annulus or ring 7 can be advanced by protraction of the piston rods 9 as shown in FIG. 2.

Ring or annulus 7 has a conical surface portion 7a and a slight inclination, so that the tubing as running out of the drawing die meets that conical surface and is pushed down by annulus 7 during normal operation. The annulus 7 may actually undergo a wobble motion, i.e. the several piston rods protract and retract over a small span rhythmically, in synchronism with the rotation of drum 4, so that the "high" point of the oblique position is adjacent the point on which freshly drawn tubing runs on and towards drum 4, while the "low" point is located oppositely thereto, to obtain pushing down of the coils.

These "high" and "low" points of annulus 7 are about aligned in FIG. 2 in a direction transverse to the plane of the drawing because the stock runs tangentially to drum 4 in about the midpoint of the drum as drawn. These "high" and "low" points are, of course, fixed in space, i.e. in relation to die 2. Consequently, the center point of annulus 7 as visible is the high point, and the low point is at the far side, i.e. to the rear of the figure. These high and low points, however, in terms of axial dimensions are only very little apart, only by about one loop-to-loop spacing on the drum.

Initially, the operation is similar to bull block operation in that particularly the front end of the tubing 1 is prepared (sharpened) for threading through die 2 and fastened to clamp 3. The die 2 has lower-most position but moves up axially as coiling beings (or the drum moves down). The drum 4 rotates slowly at first and winds a few loops onto the lower portion of drum 4. The die 2 is moved up further and the next loops are wound while being held and additionally be pressure roll 8.

The die 2 stops when reaching the annulus or ring 7, so that the withdrawn tubing runs against the frustoconical surface 7*a*. Now clamp 3 is opened, or the tube end is just severed. Due to the resulting relaxation in coiling tension, the lower coils unwind and drop into basket 6′. However, not all coils drop but several are held by roll 8. Rotation of drum 4 is now sped up and as freshly drawn tubing is wound on drum 4, ring 7 pushes the loops down so that each loop freed from roll 8 will drop into basket 6′. The drawing force is now provided through frictional engagement of, say, seven to nine loops on drum 4 as held by roll 8.

It can thus be seen that this operation can continue for any length of tubing as only a limited amount of tubing is on the drum in any instant. Newly drawn tubing is continuously accumulated in basket 6′, in that with each new coil wound, the lowest one drops into the basket.

The drawing shows the annulus as being positioned by hydraulic drive elements. However, one could use electric motors or a motor instead. The parts 10 and 9 could be stationary as far as drum rotation is concerned and the front ends of rods 9 may run in ball bearings or the like in annulus 7. In this case the oblique disposition of annulus 7 is established stationarily through the position of the rods, while the annulus rotates on an oblique axis as it is caused to rotate by follower type engagement with the drum 4. The drum 4 may have a longitudinal groove or recess in which a pin projecting from annulus 7 is inserted to follow the drum's rotation.

The invention is not limited to the embodiments described above, but all changes and modifications thereof not constituting departures from the spirit and scope of the invention are intended to be included.

We claim:

1. In a machine for drawing elongated stock such as copper tubing or the like and having a drawing die and a drum rotating on a vertical axial and onto which stock drawn by and through the die is wound and which draws the stock through the die, there being a clamp on the drum for holding the end of the stock, the improvement comprising a slightly obliquely positioned annulus, axially movably disposed on the drum; and means for displacing the annulus to assume a first position in which it places the stock as drawn through the die for positioning on the drum, while pushing coiled stock down, and a second position of retraction to enlarge the capacity of the drum without dislodging the stock as coiled thereon.

2. In a machine as in claim 1, wherein the means for displacing is hydraulically operated.

3. In a machine as in claim 1, wherein the means for displacing is electrically operated.

* * * * *